United States Patent [19]

Bradburn et al.

[11] 4,026,479

[45] May 31, 1977

[54] METHOD AND SYSTEM FOR MAINTAINING OPTIMUM THROUGHPUT IN A GRINDING CIRCUIT

[75] Inventors: Ronald G. Bradburn; Brian C. Flintoff, both of Peachland; Robert A. Walker, Kelowan; Walter A. Dutton, Dollard des Ormeaux, all of Canada

[73] Assignee: Brenda Mines Ltd., Peachland, Canada

[22] Filed: Mar. 18, 1976

[21] Appl. No.: 668,075

[30] Foreign Application Priority Data

Jan. 19, 1976 Canada ..... 243757

[52] U.S. Cl. ..... 241/30; 241/33

[51] Int. Cl.[2] ..... B02C 25/00

[58] Field of Search ..... 241/30, 33, 24

[56] References Cited

UNITED STATES PATENTS

| | | | |
|---|---|---|---|
| 3,314,614 | 4/1967 | Daniel et al. | 241/30 |
| 3,596,839 | 8/1971 | Putman | 241/30 |
| 3,779,469 | 12/1973 | Putman | 241/30 |
| 3,784,115 | 1/1974 | Krijger et al. | 241/30 |
| 3,942,727 | 3/1976 | Fahlstrom et al. | 241/34 |

*Primary Examiner*—Granville Y. Custer, Jr.
*Attorney, Agent, or Firm*—Spencer & Kaye

[57] ABSTRACT

A method and a system are disclosed for maintaining optimum throughput in a grinding circuit of the type in which fresh ore is fed to a rod mill and the ground ore from the rod mill, together with the ground ore from a ball mill operated in a reversed circuit, are combined in a pump box and pumped to a cluster of hydrocyclone classifiers. The rod mill is operated in open circuit but the ball mill is operated in closed circuit with the cyclone classifiers which serve to classify the mill discharge material, returning the oversize to the ball mill. The system comprises monitoring devices for sensing the cyclone classifier feed density and any one or combinations of the following conditions of the grinding circuit: (1) rod mill sound, (2) ball mill sound, (3) pump box level, and (4) cyclone overflow particle size and density. A constraint check and decision memory block is connected to the cyclone classifier feed density monitor and to at least one of the following overload constraints from the above corresponding monitors: (1) rod mill overload sound, (2) ball mill overload sound, (3) pump box high level, and (4) cyclone overflow high particle size and high/low density. A cascade control means is connected to the output of the cyclone classifier feed density monitor and has a control input activated by the constraint check and decision memory block. A matrix memory block is connected to a fresh ore feed rate monitor and to the rod mill sound monitor and has a control input activated by the constraint check and decision memory block, such matrix memory block being adapted to develop rod mill feed rate setpoints, as a discontinuous function of both the current rod mill feed rate and the rod mill sound. Finally, a fresh ore feed controller is connected to the output of the cascade control means and the matrix memory block, and operated by either the cascade control means or the matrix memory block depending on which one of the control inputs of the cascade control means and the matrix memory block has been activated by the constraint check and decision memory block.

8 Claims, 1 Drawing Figure

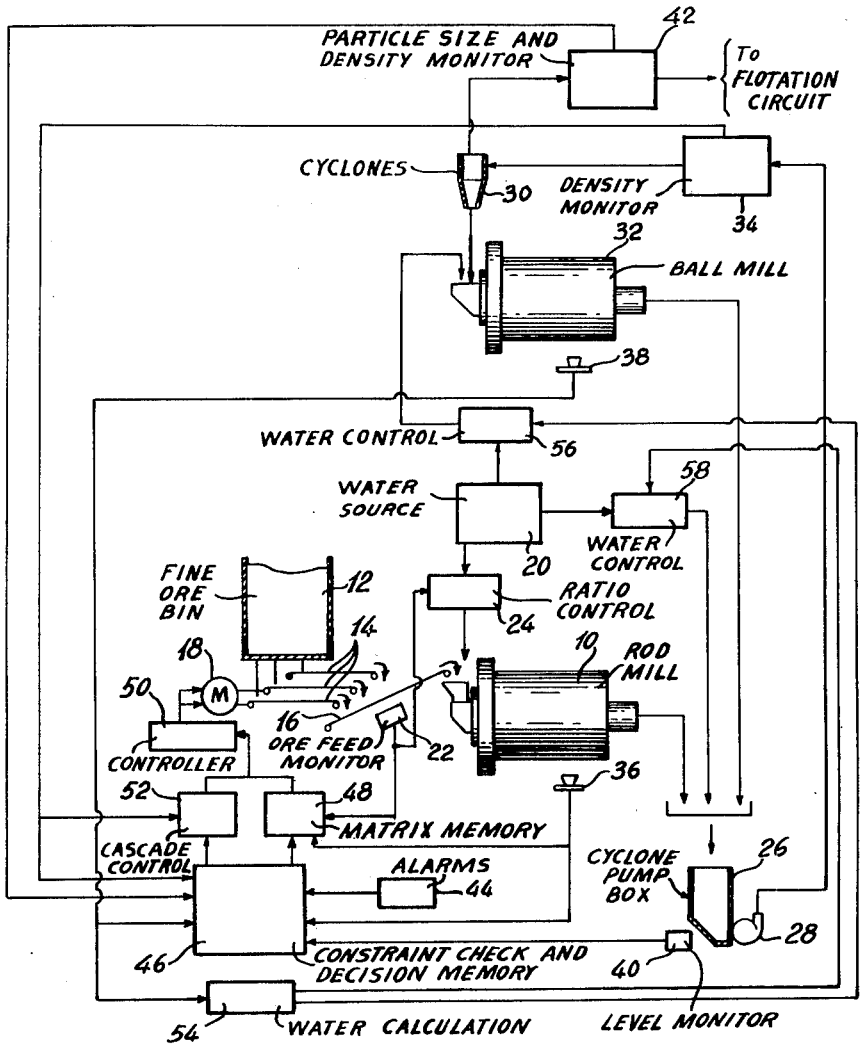
PARTICLE SIZE AND DENSITY MONITOR
42
To FLOTATION CIRCUIT
CYCLONES
30
DENSITY MONITOR
34
32
BALL MILL
38
WATER CONTROL
56
58
WATER SOURCE
20
WATER CONTROL
FINE ORE BIN
12
RATIO CONTROL
24
14
18
10
ROD MILL
50
M
16
ORE FEED MONITOR
22
CONTROLLER
36
52
48
MATRIX MEMORY
CASCADE CONTROL
ALARMS
44
CYCLONE PUMP BOX
26
28
46
CONSTRAINT CHECK AND DECISION MEMORY
40
54
WATER CALCULATION
LEVEL MONITOR

METHOD AND SYSTEM FOR MAINTAINING OPTIMUM THROUGHPUT IN A GRINDING CIRCUIT

This invention relates to a method and a system for maintaining optimum throughput in a grinding circuit.

The grinding circuit may be considered that part of a plant which reduces the size of solids materials such that they are amenable to further processing, for example, for flotation. This size reduction is accomplished by means of grinding mills which may be used singly, or in combination, in open circuit or in closed circuit with a classification device. The mills which are frequently found in industrial applications are rod mills, ball mills, tube mills, autogenous and semi autogenous mills. In general, grinding mills are characterized by their geometry and the nature of their grinding media.

One typical wet grinding circuit with which the present invention is concerned, consists of a rod mill, operated in open circuit, and a ball mill operated in a reversed circuit operation wherein the discharge of both the rod and ball mills are fed to a cluster of cyclone classifiers before being fed to the input of the ball mill. Water is added to the rod mill at the feed end, to the cyclone pump box or mill discharge sump, and optionally to the ball mill at the feed end.

Most grinding circuits are equipped with some type of automatic device to control the fresh ore feed rate. Additional automatic control devices are also installed on any of the water lines used as a part of an overall control strategy. These control devices, collectively, allow the fresh ore feed rate and water flows to be maintained at a predetermined value (setpoint or ratio), and may simply be an electronic or pneumatic analog controller, an analog computer or a digital computer.

The purpose of an automatic control system is to maintain the operation of the grinding circuit at the optimum throughput, without operator intervention despite upsets in process input parameters. The term "optimum throughput", which is used throughout this text, has the implicit definition of being the grinding circuit fresh ore feed rate at which the overall process economics are maximized.

The metallurgy of different ore bodies will determine the control criteria which will maintain optimum throughput in the grinding circuit. The following are examples of such criteria: (1) The largest possible fresh ore feed rate to the grinding circuit which will not result in undue spillage from the rod and/or full mills or inefficient grinding; (2) The largest possible fresh ore feed rate to the grinding circuit subject to a product particle size constraint; (3) A constant product particle size with the largest possible fresh ore feed rate to the grinding circuit; (4) A constant product slurry density with a product particle size constraint, and finally, (5) Any combination of the above examples.

Regardless of the strategy used, most grinding circuits add water to the rod mill in proportion to the amount of new ore added to the rod mill, which produces a more or less contant pulp density within the rod mill. Even with this type of ratio control, the pulp density will vary with the moisture content of the feed. In addition, the best density for grinding may not be the same for all feed rates or ore types. An example of the latter occurs with a change in the grinding mill feed size distribution which may have a relatively minor effect on pulp density and a major effect on pulp viscosity. Ultimately, it is the pulp viscosity which is to be controlled. However, there are no on-stream viscometers for use in grinding circuit measurements and thus the viscosity is inferred from density, since, below a critical solids concentration, the two are linearly related.

With control systems where the criteria for control is similar to that described therein, the most important controlled and independent variable in a grinding circuit is the feed rate of fresh ore. This feed rate can be used to control various dependent variables in the grinding circuit depending on the strategy used.

In an attempt to maintain a constant recirculating load through the ball mill, rod mill feed rate can be varied to maintain a constant cyclone vacuum, or a constant sump level using a constant speed pump. With the use of an on-line particle size monitor, or an accurately calibrated cyclone (model), the rod mill feed rate may be varied to maintain a constant sized product.

It is also known that the sound emanating from a rod mill varies with mill loading and one strategy is to vary the rod mill feed rate to maintain a constant sound level from the mill.

Changes in water addition to a ball mill operated in a reversed circuit will affect the volume and density of the recirculating load, the cyclone operation, and consequently the water split and solids split between the cyclone overflow and underflow. Control strategies for the ball mill water have been based on maintaining a constant ball mill pulp density/viscosity or on maintaining a constant recirculating load as might be indicated by the sump box level when a constant speed pump is used. Water addition of the same magnitude to the sump box will not affect the ball mill pulp density as directly as a change in the cyclone underflow water, but it will affect the recirculating load and cyclone operation in much the same way. Control strategies have been used to control cyclone overflow density or particle size with varying water addition to the pump box.

These various strategies to control the grinding circuit by altering the new ore feed rate and water to the rod mill, pump box or ball mill have been used separately and in combination, with different degrees of success in different mills, and no single strategy previously devised is known to work under all circumstances. One reason for this is long lag time between a change and its resulting effect through most of the circuit. This is especially true when the object of control is optimum throughput with varying ore characteristics while maintaining a fixed product size. Under these circumstances, if the rod mill is operating close to its capacity, a sudden large increase in ore size or hardness could cause an overload condition before the rest of the circuit is sufficiently affected to call for a reduction of the feed rate. Another disadvantage is that the conditions for the control system to maintain within the circuit must be chosen by the operations before the control system will operate unattended. It may be able to operate adequately under normal circumstances, but the chosen conditions may not allow optimum throughput, and an unusual change in feed or other uncontrolled variable in the circuit would require manual intervention. Because of the tuning of the control system to maintain stability and prevent excessive overshoot, it may not be able to react sufficiently rapidly to prevent overloads or oversized product, or to increase the feed rate rapidly enough to maintain the optimum throughput.

Strategies using the cyclone feed density to sense and control changes in recirculating load are also prone to suffer from upsets in the water addition control as well as changes in the feed ore characteristics, the latter for the reason given above.

The object of the present invention is to provide a method and apparatus for maintaining an optimum throughput in the grinding circuit subject to certain overload contraints placed on several of the grinding circuit units and process variables. Such grinding circuit generally comprises a rod mill to which is fed fresh ore and water and ball mill operated in closed circuit with a cluster of hydrocyclone classifiers. Both grinding mills discharge into a common pump box wherein the mill discharges are further diluted and fed to the cluster of hydrocyclone classifiers which serve to classify the mill discharge material, sending the overflow to a flotation circuit and returning the oversize to the ball mill.

The method, in accordance with the invention, uses a computer including a constraint check and decision memory block as well as a matrix memory block and comprises the steps of:

a. monitoring the cyclone classifier feed density and anyone or combinations of the following conditions in the grinding circuit:

1. rod mill sound,
2. ball mill sound,
3. pump box level, and
4. cyclone classifier overflow particle size and density;

b. feeding to the constraint check and decision memory block of the computer the output of the cyclone classifier feed density monitor and of at least one of the following overload constraints from the above corresponding monitors:

1. rod mill overload sound,
2. ball mill overload sound,
3. pump box high level, and
4. cyclone classifier overflow high particle size, and high and low density;

c. feeding to the matrix memory block of the computer the output of the rod mill sound and also the output from a fresh ore feed rate monitor, such matrix memory block developing rod mill feed rate setpoints as a discontinuous function of both the current rod mill feed rate and the rod mill sound, and d. controlling the fresh ore feed rate by a cascade control means responsive to the output of the cyclone classifier feed density monitor or from the matrix memory block depending on the operation of the constraint check and decision memory block of the computer which activates either the cascade control means or the matrix memory block depending upon the cyclone classifier feed density and the overload constraints detected.

The fresh ore feed rate is controlled from the output of the cascade control means when the density monitored by the cyclone feed density monitor and fed to the constraint check and decision block is within a predetermined range, provided that no overload constraint is detected by the constraint check and decision memory block. However, the fresh ore feed rate is controlled from the matrix memory block when the density monitored by the cyclone feed density monitor and fed to the constraint check and decision block is below the above predetermined range or an overload constraint is detected by the constraint check and decision memory block.

The above method further comprises the steps of controlling ball mill and pump box water additions in accordance with the output of the ball mill sound monitor. The pump box water addition is determined by the ball mill feed water addition and is arranged so that the total addition at these two points is constant at a predetermined optimum value.

The system, in accordance with the invention, comprises:

a. monitors for sensing the cyclone classifier feed density and at least one of the following conditions in the grinding circuit:

1. rod mill sound,
2. ball mill sound,
3. pump box level, and
4. cyclone classifier overflow particle size and density;

b. a constraint check and decision memory block connected to the output of the cyclone classifier feed density monitor and of at least one of the following overload constraints from the above corresponding monitors:

1. rod mill overload sound,
2. ball mill overload sound,
3. pump box high level, and
4. cyclone classifier overflow high particle size, and high and low density;

c. a cascade control means having a main input connected to the output of the cyclone classifier feed density monitor and a control input activated by the constraint check and decision memory block;

d. a fresh ore feed rate monitor located in the input of said rod mill;

e. a matrix memory block having main inputs connected to said fresh ore feed rate monitor and to said rod mill sound monitor and a control input activated by said constraint check and memory block, such matrix memory block being adapted to develop rod mill feed rate setpoints, as a discontinuous function of both the current rod mill feed rate and the rod mill sound; and f. a fresh ore feed controller having its main inputs connected to the output of said cascade control means and said matrix memory block and operated by either said cascade control means or said matrix memory block depending on which one of the control inputs of said cascade control means and said matrix memory block has been activated by the constraint check and decision memory block.

The system, in accordance with the invention, further comprises water control means responsive to the ball mill sound sensor for controlling water addition to the ball mill and to the pump box. The pump box water is determined by the ball mill feed water addition and is arranged so that the total water addition at these two points is constant and at a predetermined optimum value.

The invention will now be disclosed, by way of example, with reference to the accompanying drawing which illustrates an embodiment of a typical grinding circuit controlled by a system in accordance with the invention.

The grinding circuit comprises a rod mill 10 to the input of which is fed fresh ore originating from the fine ore bin 12 and moved by conveyor belts 14 and 16. The fresh ore feed rate is controlled by adjusting the speed of a variable speed motor 18 on conveyor belts 14 in a manner described later. Water is also added to the rod mill from a suitable water source 20. Water is normally fed to the rod mill in proportion to the amount of fresh ore added. The amount of fresh ore added is measured by a feed rate monitor 22 and the water addition controlled by ratio control 24. This produces a more or less constant pulp density within the mill.

The slurry emerging from rod mill 10 is fed to a pump box 26 from which it is pumped by means of pump 28 to a cluster of cyclone classifers 30. The overflow of the cyclone classifiers is fed to the regular flotation circuit whereas the underflow is fed to a ball mill 32. The slurry emerging from the ball mill 32 is returned to the pump box 26 for recirculation to the cyclone classifier cluster 30.

The system, in accordance with the invention, for maintaining an optimum throughput in the above grinding circuit includes a cyclone classifier feed density monitor 34, such as a commercial nuclear ($\gamma$ ray), gauge, located in the input line of the cyclone classifier cluster; at least one of the following monitors: a rod mill sound monitor 36, a ball mill sound monitor 38, a pump box level monitor 40 which may be a standard level indicator such as a density compensated bubble tube, a particle size and density monitor 42 located in the overflow of the cyclone classifier cluster which may be in the form of a commercial continuous system such as the Autometrics PSM 100; and the above mentioned fresh ore feed rate monitor 22. The output of the density monitor 34 and of each of the rod mill sound monitor 36, the ball mill sound monitor 38, the pump box level monitor 40, the particle size and density monitor 42 as well as various optional alarm sensors referenced by numeral 44 are fed to a constraint check and decision memory block 46. Such memory block normally forms part of a computer and is constructed, in accordance with well known techniques, in such a way as to examine the output of the above monitors and decide what action should be taken depending on the cyclone classifier feed density or, in case of an overload sensed from any one of monitors or sensors 36, 38, 40, 42 and 44. Since this memory is conventional, it does not need to be disclosed in detail. A matrix memory block 48 is also provided in the computer for controlling the fresh ore feed rate through a controller 50 connected to variable speed motor 18. The fresh ore feed rate is normally controlled by a cascade control means 52 which controls the motor speed through controller 50 as a continuous function of the output of the cyclone classifier feed density monitor 34 as long as the cyclone classifier feed density is within predetermined range, such as for example 1.67 to 1.77 gm/cc (where the specific gravity of the ore is 2.65) and as long as no overload constraint is detected by the constant check and decision memory block 46. If the cyclone feed density is below such predetermined range or if a constraint is detected by the constraint check and decision memory block 46, then control of the rod mill feed rate is transferred by the constraint check and decision memory block to the matrix memory block 48. Such matrix memory block develops rod mill feed rate setpoints for controller 50 as a discontinuous function of the fresh ore feed rate, as detected by monitor 22, and of the rod mill sound, as detected by monitor 36. The discontinuous function may be as illustrated in the following Table I;

TABLE I

| t/hr Tonnage | Sound %* | Cl = 1 57% | Cl = 2 57/62 | Cl = 3 62/70 | Cl = 4 70/80 | Cl = 5 80/90 | Cl = 6 90% |
|---|---|---|---|---|---|---|---|
| R1 = 1 240 | 20 | 10 | 0 | −0.5 | −1 | −2 | |
| R1 = 2 240/260 | 15 | 10 | 0 | −1 | −2 | −3 | |
| R1 = 3 260/280 | 10 | 7.5 | 0 | −2 | −3 | −4 | |
| R1 = 4 280/300 | 5 | 2.5 | 0 | −3 | −4 | −5 | |
| R1 = 5 300/320 | 4 | 2 | 0 | −4 | −5 | −7.5 | |
| R1 = 6 320/340 | 3 | 1.5 | 0 | −5 | −7.5 | −10 | |
| R1 = 7 340/360 | 2 | 1 | 0 | −7.5 | −10 | −15 | |
| R1 = 8 360/380 | 1 | 0.5 | 0 | −10 | −15 | −20 | |
| R1 = 9 380/400 | 0.5 | 0.25 | 0 | −15 | −20 | −30 | |
| R1 = 10 400 | 0.25 | 0.125 | 0 | −20 | −30 | −40 | |

*Arbitrary unit related to sound pressure level (db)

In the above Table I, R1 (1 to 10) represent the row numbers and C1, (1 to 6) represent the column numbers of the matrix memory block of the computer.

If, for example, the sound detected by the rod mill sound monitor is 90% (extreme overload condition) and the present tonnage detected by the feed rate monitor is between 320 and 340 tph., a reduction of 10 tph in the current setpoint is called for by the matrix memory block. The execution period, while controlled by the matrix memory block, is about one minute. It will be appreciated that this reduction represents a rapid discontinuous change in the rod mill feed rate to alleviate the overload condition. This rapidity could not be obtained from the cascade control means which is responsive to the cyclone feed density monitor and hence will suffer from lag time effects, upstream disturbances, and the relatively low magnitude of the control constants required for a stable system. It will also be noted that the feed increase or reduction is very much dependent upon the rod mill feed tonnage and rod mill sound. Low tonnage combined with low rod mill sound as well as high tonnage combined with high rod mill sound call for a large increase or decrease respectively in the feed rate. Conversely, low tonnage combined with high rod mill sound as well as high tonnage combined with low rod mill sound, call for a small decrease or increase respectively in the feed rate.

The values of the above Table I may be easily incorporated in a matrix memory by well known logic functions and it is not necessary to disclose such memory in detail.

For treatment of a pump box level constraint, feed rate additions required by the matrix control are not allowed. For treatment of constraints other than rod mill overload or pump box level, control is transferred to a predetermined column in the negative portion of the matrix memory block depending on the mill condition, and the feed rate is reduced by repetitive execution of one of the negatives entries in the Table I. Depending on the duration of the constrained condition, the matrix memory block will make corrections to the rod mill feed rate sufficient to eliminate the constraint overshoot.

With the above disclosed memory matrix, the grinding circuit may be set for maximum throughput under normal conditions without putting in any safety factors. The grinding circuit control system will react quickly enough in case of an overload constraint to reduce the fresh ore feed rate below safe value and then increase such feed rate rapidly when the overload constraint has disappeared to maintain an optimum througput.

In addition to fresh ore feed control, the present invention also incorporates a two point water control in addition to the above disclosed regular rod mill water flowrate control point which is a simple ratio control. Water from source 20 is fed to the ball mill 32 through water control device 56 and to the pump box 26 through water control device 58. The setpoints for water control devices 56 and 58 are determined in water calculation block 54.

It has been found that the ball mill sound is correlated with the pulp viscosity/density within the ball mill and thus is a good indication of the amount of water needed in the ball mill to maintain efficient grinding. The setpoint for the ball mill water flowrate is a discrete function of sound as illustrated in the following Table 2:

TABLE 2

| S = 1>17% | S = 14/17% | S = 3 11/14% | S = 4 8/11% |
|---|---|---|---|
| 0 | 30 | 60 | 90 |

In the above Table 2, S (1 to 4) is the ball mill sound value such that for a given S, (e.g. S = 2) a ball mill water flowrate in USGPM is given in row two of the table. The pump box water addition is determined by the ball mill water addition and the total addition at these two points is set so as to be constant and at a predetermined optimum value such as 1250 USGPM. Dynamic effects of water addition changes are accounted for in water calculation block 54 by suitable dynamic compensation techniques. Such dynamic compensation techniques are well known and need not be disclosed in detail.

What is claimed is:

1. A method for maintaining optimum throughput in a grinding circuit including a rod mill to which is fed fresh ore and water and operating in open circuit, and a ball mill operating in a closed circuit with a cluster of hydrocyclone classifiers, both mills discharging into a common pump box wherein the mill discharges are further diluted with water and fed to said hydrocyclone classifiers which serve to classify the mill discharge sending the overflow to further processing and returning the oversize to the ball mill, comprising the steps of:

a. monitoring the cyclone classifier feed density and any one or combinations of the following conditions in the grinding circuit:
   1. rod mill sound,
   2. ball mill sound,
   3. pump box level, and
   4. cyclone classifier overflow particle size and density;

b. feeding to a constraint check and decision memory block of a computer the outputs of the cyclone classifier feed density and of at least one of the following overload constraints from the above corresponding monitors;
   1. rod mill overload sound,
   2. ball mill overload sound,
   3. pump box high level, and
   4. cyclone classifier overflow high particle size, and high and low density;

c. feeding to a matrix memory block of the computer the output of the rod mill sound monitor as well as the output of a fresh ore feed rate monitor, said matrix memory block developing rod mill feed rate setpoints as a discontinuous function of both the current rod mill feed rate and the rod mill sound; and d. controlling the fresh ore feed rate from a cascade control means responsive to the output of the cyclone classifier feed density monitor or from said matrix memory block depending on the operation of the constraint check and decision memory block of the computer which activates either the cascade control means or the matrix memory block depending upon the cyclone classifier feed density and the overload constraints detected.

2. A method as defined in claim 1, wherein the fresh ore feed rate is controlled from the output of the cascade control means when the density monitored by the cyclone classifier feed density monitor and fed to said constraint check and decision memory block is within a predetermined range provided that no overload constraint is detected by the constraint check and decision memory block.

3. A method as defined in claim 2, wherein the fresh ore feed rate is controlled from the matrix memory block when either the density monitored by the cyclone classifier feed density monitor and fed to said constraint check and decision memory block is lower than said predetermined range or an overload constraint is detected by the constraint check and decision memory block.

4. A method as defined in claim 1, further comprising the step of controlling water addition to the ball mill and to the pump box in accordance with the output of the ball mill sound monitor.

5. A method as defined in claim 4, wherein the pump box water addition is determined by the ball mill feed water addition and is arranged so that the total addition of these two points is constant and at a predetermined optimum value.

6. A system for maintaining optimum throughput in a grinding circuit including a rod mill to which is fed fresh ore and water and operating in open circuit, and a ball mill operating in a closed circuit with a cluster of hydrocyclone classifiers, both mills discharging into a common pump box wherein the mill discharges are further diluted with water and fed to said hydrocyclone classifiers which serve to classify the mill discharge material, sending the overflow to further processing and returning the oversize to the ball mill, comprising:

a. monitors for sensing the cyclone classifier feed density and any one or combinations of the following conditions in the grinding circuit:
   1. rod mill sound,
   2. ball mill sound,
   3. pump box level, and
   4. cyclone classifier overflow particle size and density;

b. a constraint check and decision memory block having inputs connected to the output of the cyclone classifier feed density monitor and of at least one of the following overload constraints from the corresponding monitors:
   1. rod mill overload sound,
   2. ball mill overload sound,
   3. pump box high level, and
   4. cyclone classifier overflow high particle size, and high and low density;

c. a cascade control means having a main input connected to the output of said cyclone classifier feed density monitor and a control input activated by said constraint check and decision memory block;

d. a fresh ore feed rate monitor located in the output of said rod mill;

e. a matrix memory block having main inputs connected to said fresh ore feed rate monitor and to said rod mill sound monitor and a control input activated by said constraint check and decision memory block, said matrix memory block being adapted to develop rod mill feed rate setpoints as a discontinuous function of both the current rod mill feed rate and the rod mill sound; and f. a fresh ore feed controller having main inputs connected to the output of said cascade control means and said matrix memory block, and operated by either said cascade control means or said matrix memory block depending on which one of the control inputs of said cascade control means and said matrix memory block has been activated by said constraint check and decision memory block.

7. A system defined in claim 6, further comprising water control means responsive to the ball mill sound monitor for controlling water addition to the ball mill and to the pump box.

8. A system defined in claim 7, wherein the pump box water addition is determined by the ball mill feed water addition and is arranged so that the total addition at these two points is constant and at a predetermined optimum value.

* * * * *